US010047522B2

(12) United States Patent
Maywald et al.

(10) Patent No.: US 10,047,522 B2
(45) Date of Patent: Aug. 14, 2018

(54) BUILDING ENVELOPE ELEMENT COMPRISING A THERMAL INSULATING ELEMENT

(75) Inventors: Carl Maywald, Bremen (DE); Thomas Langner, Schwanewede (DE); Sebastian Gerhold, Estorf (DE); Horst-Hermann Schutze, Bremen (DE)

(73) Assignee: Vector Foiltec GMBH, Bremen (DE)

( * ) Notice: Subject to any disclaimer, the term of this patent is extended or adjusted under 35 U.S.C. 154(b) by 463 days.

(21) Appl. No.: 13/988,891

(22) PCT Filed: Nov. 24, 2011

(86) PCT No.: PCT/EP2011/070946

§ 371 (c)(1),
(2), (4) Date: Aug. 1, 2013

(87) PCT Pub. No.: WO2012/069589

PCT Pub. Date: May 31, 2012

(65) Prior Publication Data

US 2014/0007536 A1 Jan. 9, 2014

(30) Foreign Application Priority Data

Nov. 24, 2010 (DE) ..... 20 2010 015 743 U

(51) Int. Cl.
*E04D 5/10* (2006.01)
*E04H 15/20* (2006.01)
(Continued)

(52) U.S. Cl.
CPC ..... *E04D 5/10* (2013.01); *E04D 5/145* (2013.01); *E04H 15/20* (2013.01); *E04H 15/642* (2013.01); *E04H 2015/203* (2013.01)

(58) Field of Classification Search
CPC ..... E04B 9/303; E04B 2009/0492; E04B 2001/3252; E04D 5/00; E04D 5/10; E04D 5/145; E04H 15/642
(Continued)

(56) References Cited

U.S. PATENT DOCUMENTS 2,950,727 A * 8/1960 Dunn ..... 160/89
3,199,258 A * 8/1965 Jentoft et al. ..... 52/222
(Continued)

FOREIGN PATENT DOCUMENTS

DE 102006005707 8/2007
DE 102009013729 A1 * 9/2010 ..... E04H 15/64
(Continued)

OTHER PUBLICATIONS

International Search Report and Written Opinion dated May 7, 2012 from PCT Application No. PCT/EP2011/070946, 11 pages.

*Primary Examiner* — Adriana Figueroa
*Assistant Examiner* — Jessie T Fonseca
(74) *Attorney, Agent, or Firm* — Hollingsworth Davis, LLC

(57) ABSTRACT

A building cover element is described with at least one, preferably stationary arranged fastening device, which comprises an exterior section aligned to the exterior of a building to be provided with the building cover element, comprising at least one film element, which shows an exterior film layer to be arranged at the exterior of the building and anchored with an edge section at the fastening device, and with at least one thermally insulating element. The thermally insulating element is arranged with a first section at the exterior section of the fastening device and with at least one second section resting on the edge section of the exterior film layer of at least one film element.

22 Claims, 1 Drawing Sheet

(51) Int. Cl.
*E04H 15/64* (2006.01)
*E04D 5/14* (2006.01)

(58) Field of Classification Search
USPC ..... 52/222, 273, 506.06, 506.05; 160/391, 160/392, 395, 380, 402
See application file for complete search history.

(56) References Cited

U.S. PATENT DOCUMENTS

| | | | | | |
|---|---|---|---|---|---|
| 3,791,077 | A * | 2/1974 | Ventimiglia | ..... | 52/2.17 |
| 4,817,655 | A * | 4/1989 | Brooks | ..... | 135/121 |
| 4,878,322 | A * | 11/1989 | Ikeda et al. | ..... | 52/2.18 |
| 5,027,564 | A * | 7/1991 | Lechner | ..... | 52/2.23 |
| 5,209,029 | A * | 5/1993 | Foerst | ..... | 52/63 |
| 5,224,306 | A * | 7/1993 | Cramer | ..... | 52/63 |
| 5,333,425 | A * | 8/1994 | Nickerson et al. | ..... | 52/222 |
| 5,546,713 | A * | 8/1996 | Voegele et al. | ..... | 52/202 |
| 5,784,842 | A * | 7/1998 | Wackerbauer | ..... | 52/222 |
| 7,415,799 | B2 * | 8/2008 | Morris | ..... | 52/2.11 |
| 7,434,356 | B2 * | 10/2008 | Morris | ..... | 52/2.11 |
| 7,434,357 | B2 * | 10/2008 | Morris | ..... | 52/2.22 |
| 7,849,639 | B2 * | 12/2010 | Sprung | ..... | 52/82 |
| 2003/0163966 | A1 * | 9/2003 | Reynolds et al. | ..... | 52/461 |
| 2004/0079046 | A1 | 4/2004 | Lehnert | | |
| 2004/0168383 | A1 * | 9/2004 | Reynolds et al. | ..... | 52/273 |
| 2010/0037544 | A1 * | 2/2010 | Musgrave et al. | ..... | 52/222 |

FOREIGN PATENT DOCUMENTS

| | | |
|---|---|---|
| EP | 0342147 | 11/1989 |
| EP | 1350906 | 10/2003 |
| EP | 1348823 | 3/2008 |

* cited by examiner

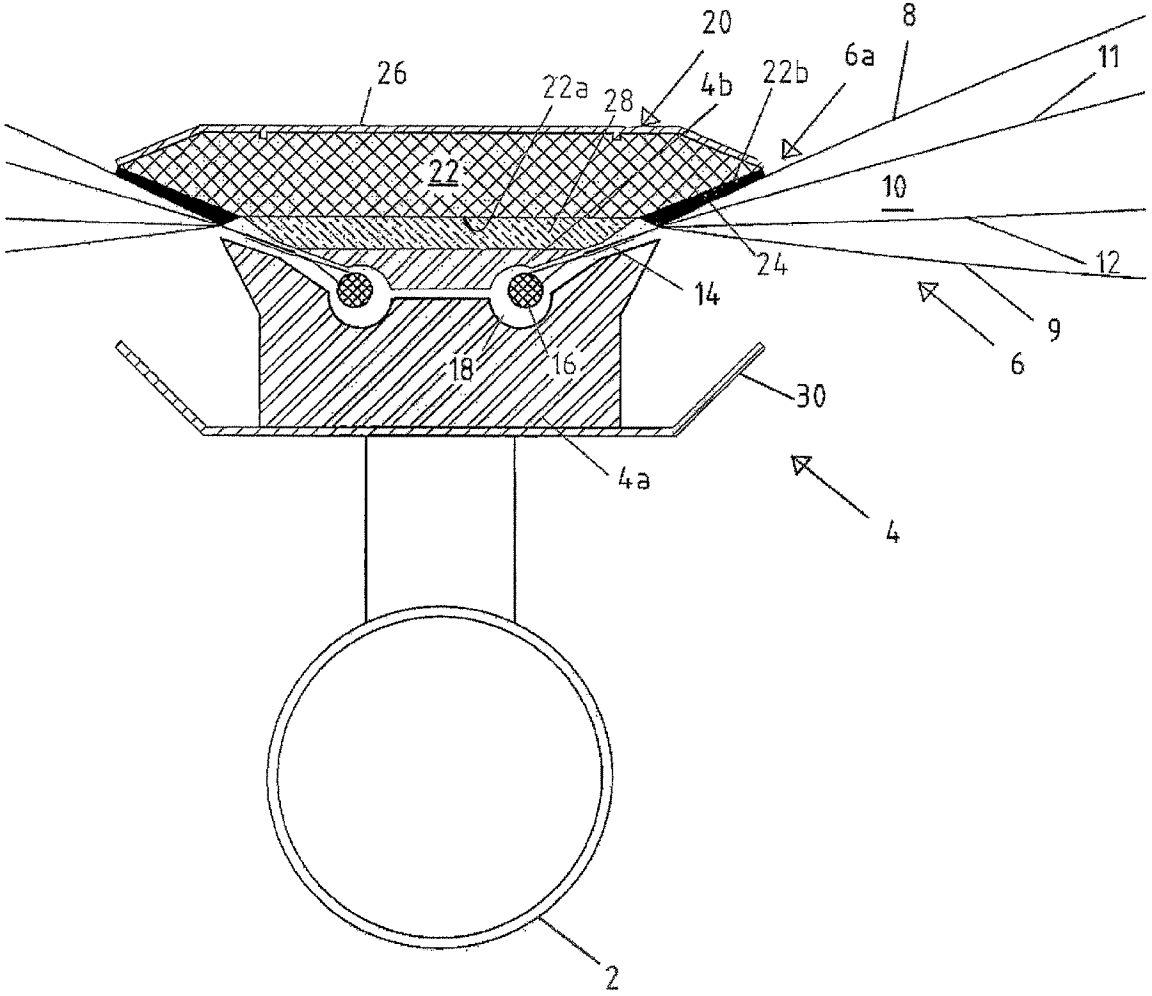
8
11
6a
10
12
22b
9
20
4b
6
28
24
22a
14
22
26
30
4
16
18
4a
2

BUILDING ENVELOPE ELEMENT COMPRISING A THERMAL INSULATING ELEMENT

The invention relates to a building cover element with at least one, preferably stationary arranged fastening device, which shows an exterior section aligned to the outside of a building to be provided with the building cover element, with at least one film element comprising an exterior film layer to be arranged at the exterior of the building and anchored with an edge section at the fastening device, and with at least one thermally insulating element. Further the invention relates to a thermally insulating element for a building cover element, which comprises at least one preferably stationary arranged fastening device showing an exterior section, which is aligned to the exterior of the building to be provided with a building cover element, and comprises at least one film element, which shows an exterior film layer to be arranged at the exterior of the building and anchored with an edge section at the fastening device.

Such housing cover elements are known and have been used for quite some time, among other things, to form film roof systems as well as film façade systems. Film roof systems and film façade systems are particularly used in the construction of shopping centers, gymnasiums, entertainment parks, and other commercial buildings, in which conventional roofing is not recommended, either for constructive, economic, or optic reasons.

It has shown in practice that a thermal bridge can develop in the area of the anchoring of a film element at the fastening device, by which the insulating effect of a film system can essentially be lost entirely. This disadvantageous effect is particularly noticeable in large temperature differences between the interior and the exterior of the housing cover element, particularly in case of low exterior temperatures. Usually the fastening device comprises a metallic frame, at which the film element is anchored, with this sometimes even amplifying the above-described effect.

When the film element is embodied as a film cushion, comprising at least one exterior film layer and one interior film layer, aligned towards the interior of the building, with a gas-tight sealed cavity being formed between these two film layers, in which gas, particularly air is included, EP 1 348 823 B1 suggests for the purpose of avoiding the above-mentioned problem to arrange a thermally insulating element inside the film cushion, which keeps the two outside film layers at a distance also in the area of the anchoring at the fastening device. This way any thermal bridge previously developing at this point is omitted and the thermally insulating effect of the gas cushion in the film cushion is maintained up to the anchoring at the fastening device. This construction has well proven in practice in the meantime.

However the invention now suggests in a building cover element of the type mentioned at the outset to arrange the thermally insulating element with a first section at the exterior section of the fastening device and with a second section at the exterior edge section of the exterior film layer of at least one film element.

Accordingly the thermally insulating element according to the invention projects beyond the fastening device, which usually represents a metallic profile, and forms a thermal insulation with the adjacent edge section of the film element, yielding a balanced adiabatic condition.

Another advantage of the solution according to the invention comprises that the film element and the thermally insulating element form no constructive and design unit, but can be produced and assembled independent from each other and thus the use of the thermally insulating element according to the invention has not influence upon the construction of the film element and is therefore entirely independent therefrom. This way not only the assembly is facilitated, because the thermally insulating element only needs to be arranged at the exterior of the fastening device and the adjacent edge section of the film element, but additionally the option develops to retrofit existing and already installed building cover elements with thermally insulating elements. Additionally, by the solution according to the invention the use of the thermally insulating element is not limited to a film cushion, but other constructions and embodiments of film elements are also possible; for example the solution according to the invention allows the use of a thermally insulating element e.g., also in a single-layer film element, which therefor shows no multi-layer film cushion but comprises a single layer of film.

Preferred embodiments and further developments of the invention are disclosed in the dependent claims.

Preferably the thermally insulating element may comprise an insulating body made from a thermally insulating solid material, preferably hard foam, and, in the area of the second section of the thermally insulating element, the insulating body may rest directly on the exterior edge section of the exterior film layer of the film element or on an insulating sealing strip preferably extending at the thermally insulating element. This embodiment yields a low cost and simultaneously robust construction.

Further, an exterior metallic layer, preferably made from aluminum, may be arranged at the exterior of the insulating body and/or the interior metallic layer, preferably made from aluminum, at the interior of the insulating body pointing towards the fastening device outside the second section. In another further development of these embodiments the metallic layer(s) is (are) connected fixed to the insulating body, preferably adhered. Additionally the metallic layer can beneficially comprise a metal profile. By using such metallic layers the stability and stiffness of the thermally insulating element can be further increased, which has beneficial effects upon the handling, particularly during the assembly.

Another preferred embodiment, in which the fastening device comprises a first fastening section, at which the edge section of a film element is anchored, and a second fastening section, particularly approximately opposite the first fastening section, at which the edge section of another film element is anchored, is characterized in that the thermally insulating element is arranged with its first section at the exterior section of the fastening device between its two fastening sections and with a second section on the exterior edge section of the exterior film layer of the film element and with a third section on the exterior edge section of the exterior film layer of another film cushion.

At his point it shall be mentioned for reasons of completeness that "building cover element" not only relates to roof or façade elements but also to a building element separating two buildings from each other.

In the following a preferred exemplary embodiment of the invention is explained in greater detail using the attached drawing. It shows:

FIG. 1 schematically in a cross-section a detail of a film façade or roofing system with a fastening and sections of film cushions fastened thereat at both sides.

A film façade or film roofing system of the type discussed here comprises a plurality of film elements essentially arranged side-by-side as well as a framework structure, at which the film elements are anchored, and which therefore serves as the fastening device for the film elements. FIG. 1 shows a detail of a preferred embodiment of a film roofing system, in which the film elements are made from film cushions.

Concretely, FIG. 1 shows a frame profile 2 as a part of the above-mentioned framework structure as an example. At one side of the frame profile, in the illustration of FIG. 1 it is the top, a fastening 4 is arranged which in the exemplary embodiment shown comprises a base profile 4*a* and a lid profile 4*b*. The fastening 4 is fastened with the base profile 4*a* at the frame 2, namely for example via screws discernible in FIG. 1 and indicated in dot-dash lines, but not described in greater detail.

Further, FIG. 1 shows sections of two film cushions 6 side-by-side as examples, each showing a top film 8 and a bottom film 9. The top film 8 and the bottom film 9 form two exterior film layers, limiting the respective film cushion 6 and encasing a cavity 10 in a gas-tight fashion. Air is injected under pressure into the cavity 10 causing the top film 8 and the bottom film 9 to be respectively stretched and giving the film cushion 6 the desired form. Thereafter the top film 8 and the bottom film 9 form an air cushion between each other in the cavity 10. In the exemplary embodiment shown the film cushions 6 also show two intermediate films 11, 12 dividing the cavity 10 into three sections.

The film cushions 6 are anchored at the fastening 4 via a circumferential edge section 6*a*. For this purpose, the ends of the films 8, 9, 11, and 12 are welded to a joint layer in the edge section 6*a* of the film cushion 6, forming an anchoring section 14. The anchoring section 14 is provided with a beading rope 16 along its edge, encompassing the layer jointly formed by the films 8, 9, 11, and 12.

As further discernible from FIG. 1 the film cushions 6 are anchored at the fastening 4 such that their anchoring section 14 is clamped between the base profile 4*a* and the lid profile 4*b* and the beading rope 16 is arranged in a recess 18 embodied in the base profile 4*a* and closed by the lid profile 4*b*. For this purpose the lid profile 4*b* is pressed against the base profile 4*a* with the help of components not shown.

The structural unit formed by at least one fastening 4 and at least one film cushion 6 can also be called a building cover element.

While the base film 9 points to an interior space limited or encased by the film façade and/or roofing system discussed here, thus forming the interior of the film cushion, the top film 8 of the film cushions 10 contacts the exterior of the film façade and/or cover system. Accordingly the lid profile 4*b* also forms an exterior section of the fastening 4. Primarily, the film façade and/or roofing system discussed here is used to separate an interior space from an exterior environment and thus forming an outer cover, particularly a roof for a building. Alternatively it is generally also possible that the film system in question here is also used as a separating wall system to separate two building sections from each other or to separate two interior spaces within a building so that in such a case, in an arrangement shown for example in FIG. 1, the exterior formed by the top films 8 of the film cushions 10 and the lid profile 4*b* of the fastening 4 points to the other building section or to the other interior space and thus limit it.

In practice it has shown that a thermal bridge can develop in the area of the anchoring of the film cushions 6 at the fastening 4 between the top film 8 and the bottom film 9 and thus between the exterior and the interior and/or between two sides of the film cushions 6. Here, the insulating effect of the cavity 10 filled with air in the film cushions 6 can be compromised or essentially even be lost entirely. This disadvantageous effect is particularly noticeable in large temperature differences between the two sides of the film cushions 6. Additionally, it is disadvantageous in this context when the lid profile 4*b* with its end sections extends beyond the base profile 4*a* in the direction to the film cushions 6, here contacting the exterior edge section 6*a* of the film cushions 6, and thus in this area comes to rest on the top film 8 of the film cushions 6; because in such a case the above-described effect would be even enhanced, last but not least because the lid profile 4*b* is made from metal.

In order to prevent the development of a thermal bridge a thermally insulating element 20 is used, which is arranged at the exterior of the lid profile 4*b* of the fastening 4, as discernible in FIG. 1. In the exemplary embodiment shown the thermally insulating element 20 comprises an essentially plate-shaped solid body 22 with its material showing good thermally insulating features. For example hard foam can be used as the material. As further discernible from FIG. 1 the insulating solid body 22 rests with its bottom 22*a* pointing towards the fastening 4 in the area of its edge sections 22*b* adjacent to the film cushions 6 via an insulating sealing strip 24 on the exterior of the top film 8 in the edge section 6*a* of the film cushion 6. The insulating sealing strips 24 preferably comprise soft foam, embodied like foam rubber, and are fastened preferably at the bottom of the insulating solid body 22, particularly by way of adhesion. Alternatively in general it is also possible to waive the sealing strips 24 and to establish a direct contact between the top film 8 of the film cushions 6 and the insulating solid body 22 of the thermally insulating element 20.

As further discernible from FIG. 1 the thermally insulating element 20 comprises an upper metallic profile 26 and a lower metallic profile 28, with these two metallic profiles 26, 28 quasi framing the insulating solid body 22 and preferably comprising aluminum and being fastened thereat by way of adhesion. As also discernible from FIG. 1 the upper metallic profile 26 essentially covers the top of the insulating solid body 22, while the lower metallic profile 28 exposes the bottom 22*a* of the insulating solid body 22 in the respective section, at which the sealing strip 24 is arranged and a thermal connection is established between the top film 8 of the film cushions 6 and the insulating solid body 22. Not only the lower metal profile 28 of the thermally insulating element 20 ends ahead of said section 22*b* but also both the lid profile 4*b* as well as the base profile 4*a* of the fastening 4, as further discernible from FIG. 1. Thus, the lid profile 4*b* does not project laterally beyond the fastening profile 4*a*, also ensuring here that the top film 8 in the edge section 6*a* of the film cushions 6 is left clear for a direct thermal connection via the sealing strip 24 to the insulating solid body 22 of the thermally insulating element 20. Accordingly, the thermally insulating element 20 projects with its two lateral edges beyond the fastening 4 and rests to this extent on the top film 8 of the respectively adjacent film cushion 6.

The thermally insulating element 20 is preferably fastened at the lid profile 4*b* of the fastening 4. The components required here are not shown in FIG. 1. Usually, the thermally insulating element 20 is screwed to the fastening 4. In general other fastening options are possible, too.

Finally it shall be mentioned that in the exemplary embodiment shown according to FIG. 1 a condensate channel 30 is arranged between the frame 2 and the fastening 4 in order to collect any condensate potentially developing in spite of the use of the above-described thermally insulating elements 20.

The invention claimed is:

1. A building cover element with at least one fastening device comprising an interior section and an exterior section, wherein the exterior section comprises an inner side and an outer side, the outer side of the exterior section of the fastening device being aligned to an exterior of a building to be provided with the building cover element, with at least one film element comprising an exterior film layer to be arranged at the exterior of the building and anchored with an edge section to the fastening device between its interior section and the inner side of its exterior section wherein the exterior film layer and its edge section comprises an inner side and an outer side, the outer side of the exterior film layer and its edge section being aligned toward the exterior of the building, and with at least one thermally insulating element comprising an inner side and an uncovered outer side, wherein the thermally insulating element is arranged with a first section of its inner side covering the outer side of the exterior section of the fastening device and with at least one second section of its inner side on the outer side of the edge section of the exterior film layer of the at least one film element.

2. A thermally insulating element for a building cover element, which comprises at least one fastening device comprising an interior section and an exterior section wherein the exterior section comprises an inner side and an outer side, the outer side of the exterior section of the fastening device being aligned to an exterior of a building to be provided with the building cover element, and at least one film element comprising an exterior film layer to be arranged at the exterior of the building and with an edge section anchored to the fastening device between its interior section and the inner side of its exterior section wherein the exterior film layer and its edge section comprises an inner side and an outer side, the outer side of the exterior film layer and its edge section being aligned toward the exterior of the building, wherein the thermally insulating element comprises an inner side and an uncovered outer side and a first section of the inner side of the thermally insulating element is embodied to cover the outer side of the exterior section of the fastening device and at least one second section of the inner side of the thermally insulating element is embodied to rest on the outer side of the edge section of the exterior film layer of the at least one film element.

3. An element according to claim 1, wherein the film element is embodied as a film cushion, which in addition to the exterior film layer comprises at least one interior film layer facing an inside of the building, with at least one cavity being formed between these two film layers in a gas-tight, sealed fashion, comprising gas.

4. An element according to claim 1, wherein the thermally insulating element comprises an insulating body made of thermally insulating solid material and the insulating body in an area of the second section of the thermally insulating element rests directly on the edge section of the exterior film layer of the film element or via an insulating sealing strip.

5. An element according to claim 4, wherein the outer side of the insulating body comprises an exterior metallic layer.

6. An element according to claim 4, wherein an interior metallic layer is arranged at an inside of the insulating body facing the fastening device outside the second section.

7. An element according to claim 5, wherein the metallic layer is connected fixed to the insulating body.

8. An element according to claim 5, wherein the metallic layer is made from a metallic profile.

9. An element according to claim 1, in which the fastening device comprises a first fastening section, with the edge section of the at least one film element being anchored thereat, and a second fastening section approximately opposite the first fastening section, at which an edge section of another film element is anchored, wherein the thermally insulating element rests with its first section at the exterior section of the fastening device between its two fastening sections and with the at least one second section on the edge section of the exterior film layer of the at least one film element and with a third section on the edge section of an exterior film layer of the another film element.

10. An element according to claim 6, wherein the metallic layer is connected fixed to the insulating body.

11. An element according to claim 2, wherein the film element is a film cushion, which in addition to the exterior film layer comprises at least one interior film layer facing an inside of the building, with at least one cavity being formed between these two film layers in a gas-tight, sealed fashion, comprising gas.

12. An element according to claim 2, wherein the thermally insulating element comprises an insulating body made of thermally insulating solid material and the insulating body in an area of the second section of the thermally insulating element rests directly on the edge section of the exterior film layer of the film element or via an insulating sealing strip.

13. An element according to claim 12, wherein the outer side of the insulating body comprises an exterior metallic layer.

14. An element according to claim 12, wherein an interior metallic layer is arranged at an inside of the insulating body facing the fastening device outside the second section.

15. An element according to claim 13, wherein the metallic layer is connected fixed to the insulating body.

16. An element according to claim 14, wherein the metallic layer is connected fixed to the insulating body.

17. An element according to 13, wherein the metallic layer is made from a metallic profile.

18. An element according to claim 2, in which the fastening device comprises a first fastening section, with the edge section of the at least one film element being anchored thereat, and a second fastening section approximately opposite the first fastening section, at which an edge section of another film element is anchored, wherein the thermally insulating element rests with its first section at the exterior section of the fastening device between its two fastening sections and with the at least one second section on the edge section of the exterior film layer of the at least one film element and with a third section on the edge section of an exterior film layer of the another film element.

19. An element according to claim 4, wherein the thermally insulating solid material is hard foam.

20. An element according to claim 12, wherein the thermally insulating solid material is hard foam.

21. An element according to claim 6, wherein the metallic layer is made from a metallic profile.

22. An element according to 14, wherein the metallic layer is made from a metallic profile.

* * * * *